US011459071B2

(12) United States Patent
Ebisui et al.

(10) Patent No.: US 11,459,071 B2
(45) Date of Patent: Oct. 4, 2022

(54) PERSONAL WATERCRAFT

(71) Applicant: KAWASAKI MOTORS, LTD., Hyogo (JP)

(72) Inventors: Hideaki Ebisui, Kakogawa (JP); Masaaki Miyoshi, Kobe (JP); Yoshinobu Uozumi, Amagasaki (JP)

(73) Assignee: KAWASAKI MOTORS, LTD., Akashi (JP)

( * ) Notice: Subject to any disclaimer, the term of this patent is extended or adjusted under 35 U.S.C. 154(b) by 30 days.

(21) Appl. No.: 17/090,795

(22) Filed: Nov. 5, 2020

(65) Prior Publication Data

US 2022/0135191 A1 May 5, 2022

(51) Int. Cl.

| | |
|---|---|
| ***B63B 49/00*** | (2006.01) |
| ***B63B 3/48*** | (2006.01) |
| ***B63H 25/52*** | (2006.01) |
| ***B63B 79/40*** | (2020.01) |
| ***B63B 29/04*** | (2006.01) |

(52) U.S. Cl.

CPC ..... *B63B 49/00* (2013.01); *B63B 3/48* (2013.01); *B63B 29/04* (2013.01); *B63B 79/40* (2020.01); *B63H 25/52* (2013.01); *B63B 2029/043* (2013.01)

(58) Field of Classification Search

CPC ..... B63B 49/00; B63B 79/40; B63B 3/48; B63B 29/04; B63H 25/52

See application file for complete search history.

(56) References Cited

U.S. PATENT DOCUMENTS

| | | | | |
|---|---|---|---|---|
| 5,894,810 | A * | 4/1999 | Orr | B60R 11/0211 114/343 |
| 8,720,355 | B2 * | 5/2014 | Aoyama | B63B 34/10 114/55.53 |
| 8,861,775 | B2 * | 10/2014 | McPherson | H04R 1/026 381/86 |
| 10,582,280 | B2 * | 3/2020 | Clement | H04R 1/2896 |
| 2007/0171315 | A1 * | 7/2007 | Aoyama | G01S 19/19 342/357.57 |
| 2018/0310081 | A1 * | 10/2018 | Clement | B63B 34/10 |
| 2018/0317004 | A1 * | 11/2018 | Sheedy | G06F 3/165 |

* cited by examiner

*Primary Examiner* — S. Joseph Morano
*Assistant Examiner* — Jovon E Hayes
(74) *Attorney, Agent, or Firm* — Alleman Hall Creasman & Tuttle LLP

(57) ABSTRACT

A personal watercraft includes: a watercraft body including a hull and a deck covering an upper portion of the hull; a handle located above the deck; a straddle seat located rearward of the handle; and at least one speaker assembly located forward of the straddle seat and above the lowest point of an upper surface of the straddle seat.

11 Claims, 6 Drawing Sheets

PERSONAL WATERCRAFT

BACKGROUND OF THE INVENTION

Technical Field

An aspect of the present disclosure relates to a personal watercraft.

Description of the Related Art

In a personal watercraft equipped with a straddle seat on which a user sits in a straddling position, two speaker assemblies may be mounted in the vicinity of the respective front ends of right and left foot-wells (see U.S. Pat. No. 10,582,280 B2, for example).

SUMMARY OF THE INVENTION

A personal watercraft according to an aspect of the present disclosure includes: a watercraft body including a hull and a deck covering an upper portion of the hull; a handle located above the deck; a straddle seat located rearward of the handle; and at least one speaker assembly located forward of the straddle seat and above the lowest point of an upper surface of the straddle seat.

In the above configuration, where the speaker assembly is located above the lowest point of the upper surface of the straddle seat, sounds from the speaker assembly can easily reach the location of the seated operator and locations rearward of the seated operator.

The above and further objects, features and advantages of the present disclosure will be more apparent from the following detailed description of preferred embodiments with reference to the accompanying drawings.

DETAILED DESCRIPTION OF THE EMBODIMENTS

Hereinafter, exemplary embodiments will be described with reference to the drawings.

Figure 1:
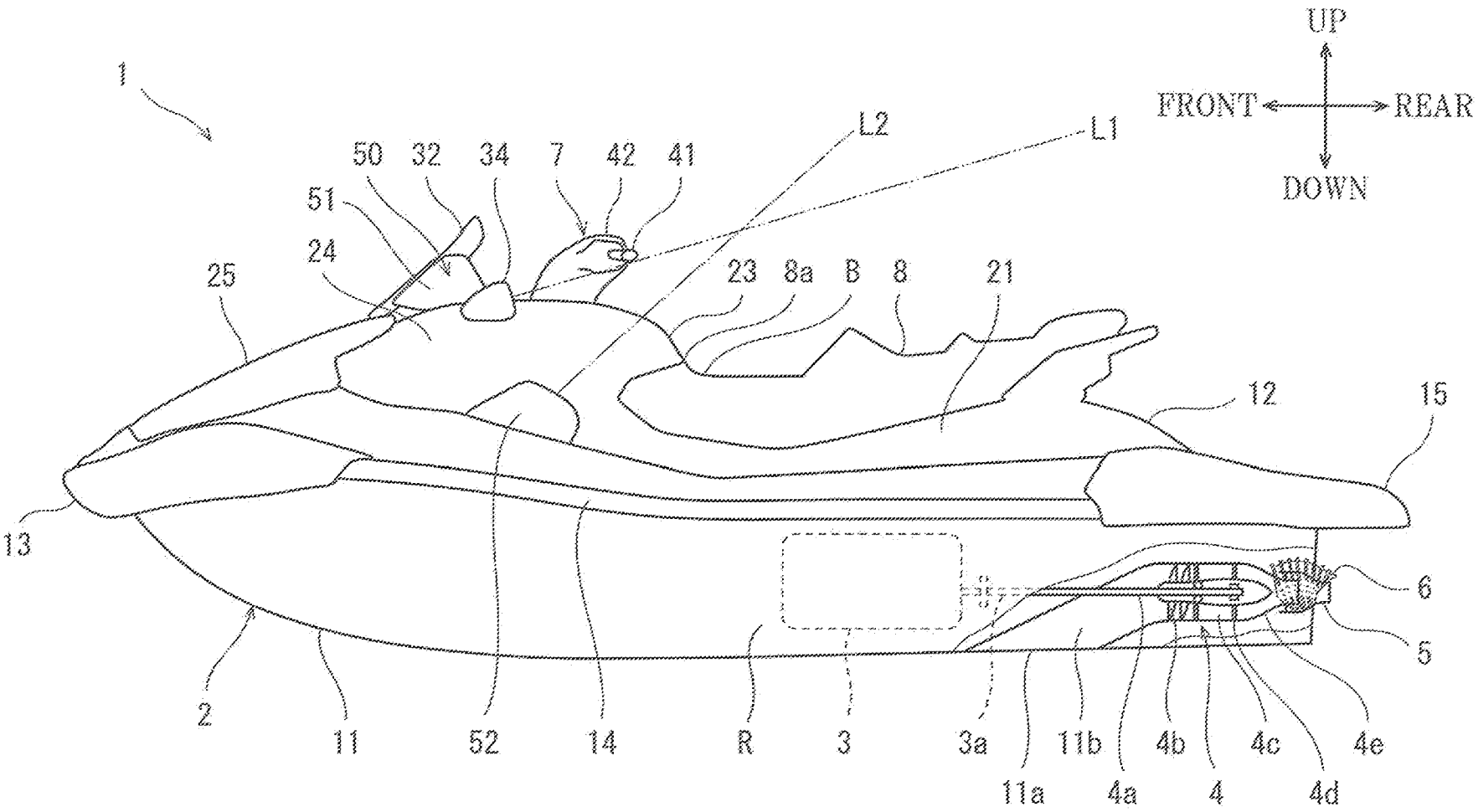
FIG. 1 is a partially cutaway side view of a personal watercraft according to an exemplary embodiment.
Figure 2:
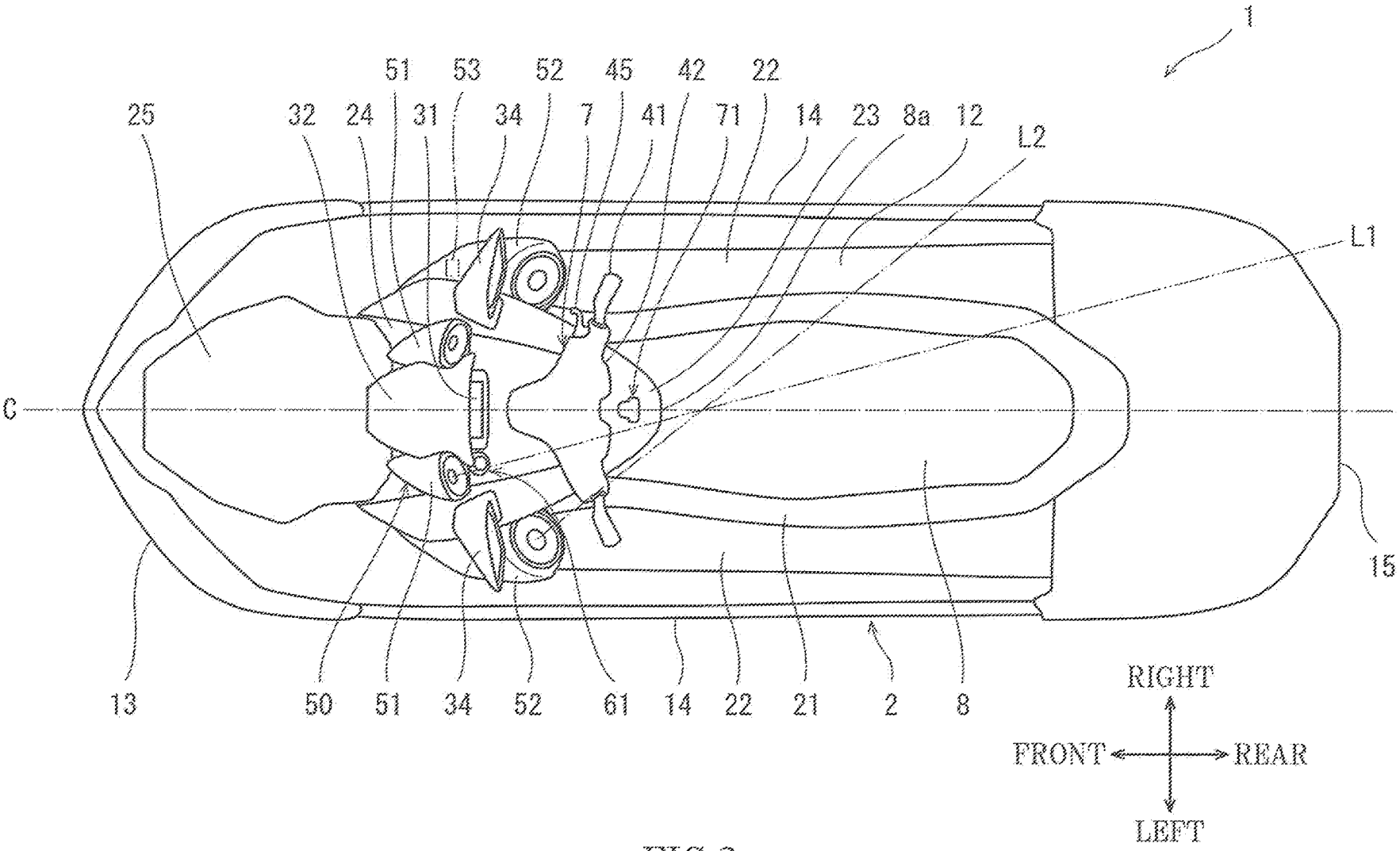
FIG. 2 is a top view of the personal watercraft of FIG. 1.
Figure 3:
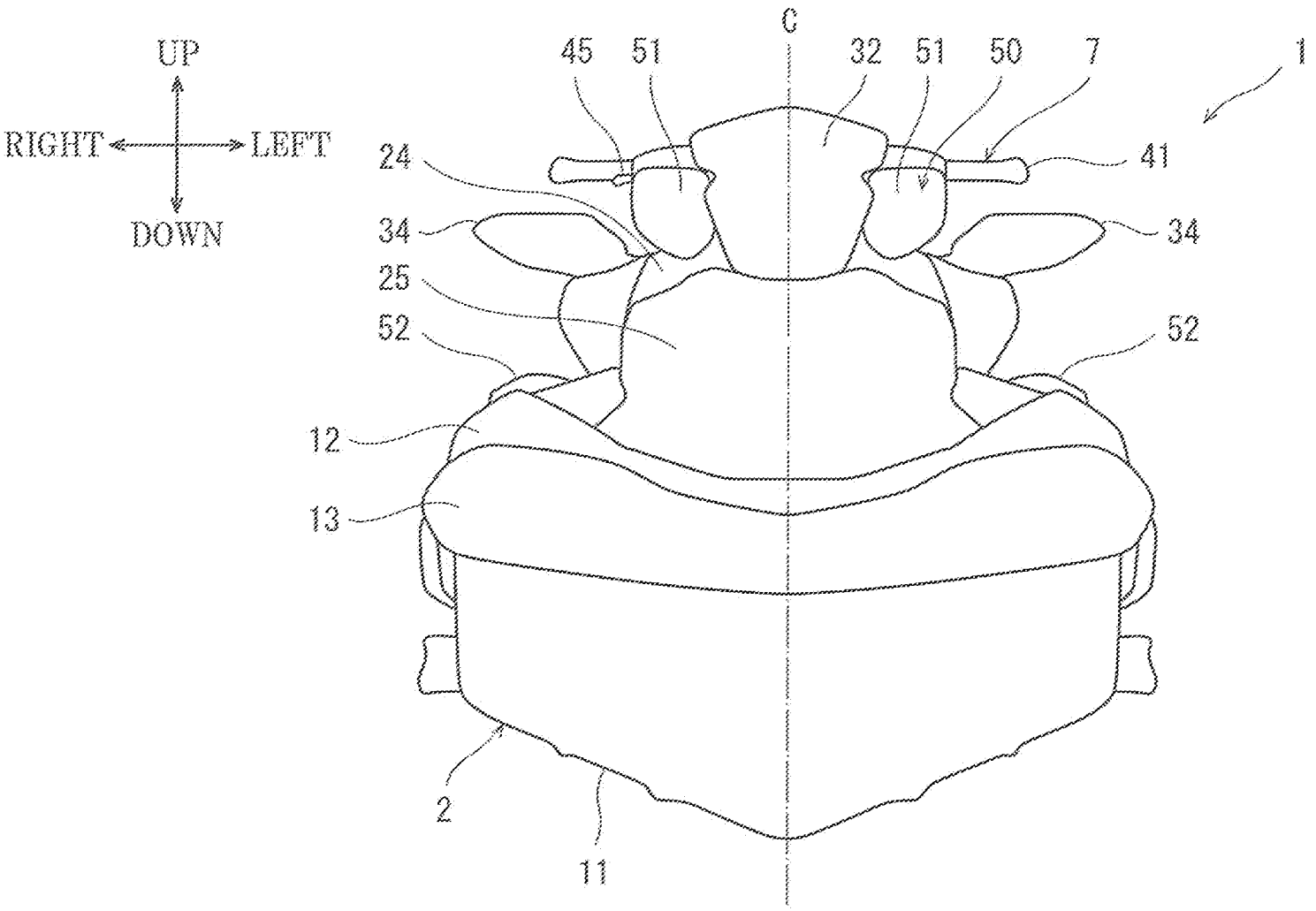
FIG. 3 is a front view of the personal watercraft of FIG. 1.

FIG. 1 is a partially cutaway side view of a personal watercraft 1 according to an exemplary embodiment. FIG. 2 is a top view of the personal watercraft 1 of FIG. 1. FIG. 3 is a front view of the personal watercraft 1 of FIG. 1. The personal watercraft 1 includes a watercraft body 2. The directions mentioned in the following description are those coinciding with the directions in which the operator sitting on a seat 8 described later faces. The vertically up-down direction and the transverse direction with respect to the watercraft body 2 at rest on the water will be respectively referred to as the "vertical direction" and the "horizontal direction" of the watercraft body 2. The right-left direction of the watercraft body 2 may be referred to as the "watercraft body width direction".

The watercraft body 2 includes a hull 11 and a deck 12 covering the upper portion of the hull 11. The watercraft body 2 includes a front bumper 13, two side bumpers 14, and a rear bumper 15. The front bumper 13 is located forward of and covers the front end portions of the hull 11 and the deck 12. The side bumpers 14 are located lateral to and cover the side edge portions of the hull 11 and the deck 12. The rear bumper 15 is located rearward of and covers the rear end portions of the hull 11 and the deck 12.

Referring to FIG. 1, the interior of the watercraft body 2 includes an engine room R, in which an engine 3 serving as a prime mover is accommodated. The output shaft of the engine 3 is connected to a propeller shaft 3*a* extending rearward. The rear end of the propeller shaft 3*a* is connected to a pump shaft 4*a* of a water jet pump 4 located in the rear of the hull 11. An impeller 4*b* is mounted on the pump shaft 4*a*. A stator vane 4*c* is located rearward of the impeller 4*b*. A pump casing 4*d* is located radially outward of the impeller 4*b* and encloses the impeller 4*b*.

A water inlet 11*a* opens at the bottom of the hull 11. The water inlet 11*a* and the pump casing 4*d* are in communication via a water passage 11*b*. The pump casing 4*d* is provided with a pump nozzle 4*e* facing rearward of the watercraft body 2. The pump nozzle 4*e* decreases in diameter from front to rear, and an ejection orifice opens at the rear end of the pump nozzle 4*e*. To the ejection orifice of the pump nozzle 4*e* is connected a steering nozzle 5 which is swingable in the right-left direction. A bowl-shaped reverse bucket 6 is located in the vicinity of the steering nozzle 5. The reverse bucket 6 is pivotally supported by the hull 11 and pivotable between an advanced position where the reverse bucket 6 covers the ejection orifice of the steering nozzle 5 from behind to cause water ejected from the pump nozzle 4*e* to be redirected forward and a retracted position where the reverse bucket 6 allows the ejection orifice of the steering nozzle 5 to be open in the rearward direction.

In the personal watercraft 1, water drawn into the hull 11 through the water inlet 11*a* located at the bottom of the hull 11 is pressurized and accelerated by rotational power of the impeller 4*b* of the water jet pump 4 driven by the engine 3. The flow of water is regulated by the stator vane 4 and ejected rearward through the ejection orifice of the pump nozzle 4*e* and the steering nozzle 5 to produce propulsion power.

The deck 12 includes a seat support 21 and a pair of foot rests 22. The seat support 21 projects upward from the deck floor on which users can walk. The seat support 21 supports the seat 8 from below. The seat 8 is a straddle seat on which a user sits in a straddling position. Referring to FIG. 2, the two foot rests 22 are located to the right and left of the seat support 21, respectively. The foot rests 12*b* constitute a part of the deck floor.

A steering assembly 7 is located forward of the seat 8. The steering assembly 7 includes a bar-shaped handle 41 located above the deck 12. The handle 41 includes an accelerator lever (throttle lever) 45 as an accelerator. The accelerator lever 45 is located to the right of a center plane C dividing the watercraft body 2 into right and left halves. Once the accelerator lever 45 is operated, the flow rate of air supplied to the engine 3 from outside the watercraft body 2 is adjusted, and accordingly the rotational power of the impeller 4*b* of the water jet pump 4 is changed. The handle 41 is pivotable relative to the deck 12. When the operator tilts the handle 41 to the right or left, the steering nozzle 5 swings to the right or left in conjunction with the tilting of the handle 41, thereby changing the movement direction of the personal watercraft 1.

Figure 4:
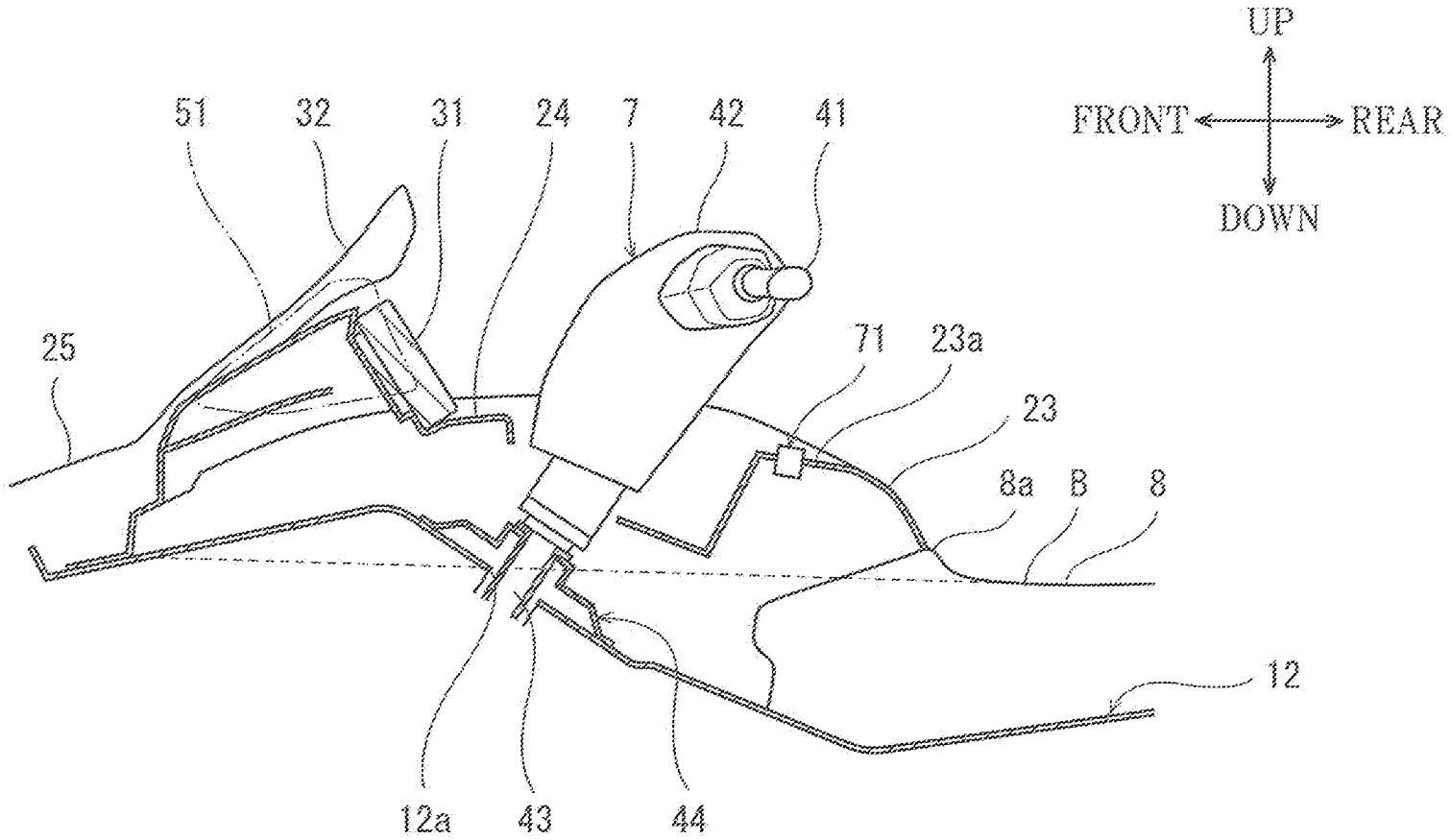
FIG. 4 is a partially enlarged view of the personal watercraft of FIG. 1, showing a steering assembly and its vicinity in vertical cross-section.

FIG. 4 is a partially enlarged view of the personal watercraft 1 of FIG. 1, showing the steering assembly 7 and its vicinity in vertical cross-section. The steering assembly 7 includes a handle cover 42, a steering shaft 43, and a shaft support 44 in addition to the handle 41 described above.

The handle cover 42 covers a laterally central portion of the handle 41. The laterally central portion of the handle 41 is connected to the upper end of the steering shaft 43. The steering shaft 43 extends obliquely forward and downward from the point of connection to the handle 41 and is inserted into an opening 12*a* of the deck 12. That is, the steering shaft 43 penetrates the deck 12 in the up-down direction. The shaft support 44 is a steering post pivotally supporting the steering shaft 43 so that the steering shaft 43 is pivotable relative to the deck 12. The shaft support 44 is mounted around the opening 12*a* of the deck 12. A first cover 23 and a second cover 24 are disposed above the shaft support 44 to cover from above the shaft support 44 and the space around the shaft support 44.

The first cover 23 is located above the foot rests 22 and covers from above the space lying behind the shaft support 44. The first cover 23 is located rearward of the shaft support 44 and forward of a laterally central front end 8*a* of the seat 8.

The second cover 24 is located above the foot rests 22 and covers from above the space lying ahead of the shaft support 44. The second cover 24 is located forward of the first cover 23. An openable hatch cover 25 is located forward of the second cover 24 (see also FIGS. 1 and 2).

The second cover 24 located forward of the handle 41 supports a meter device 31 as a display and a meter cover 32 covering the meter device 31 from above. Thus, in the present embodiment, the second cover 24 serves as a display support supporting the display. The meter device 31 displays at least one selected from watercraft body speed information, total fuel amount information, the remaining oil amount information, and the remaining battery charge information. The meter device 31 may present an error display or a warning display. As seen from FIGS. 2 and 3, two side mirrors 34 are located to the right and left of the meter device 31, respectively.

Figure 5:
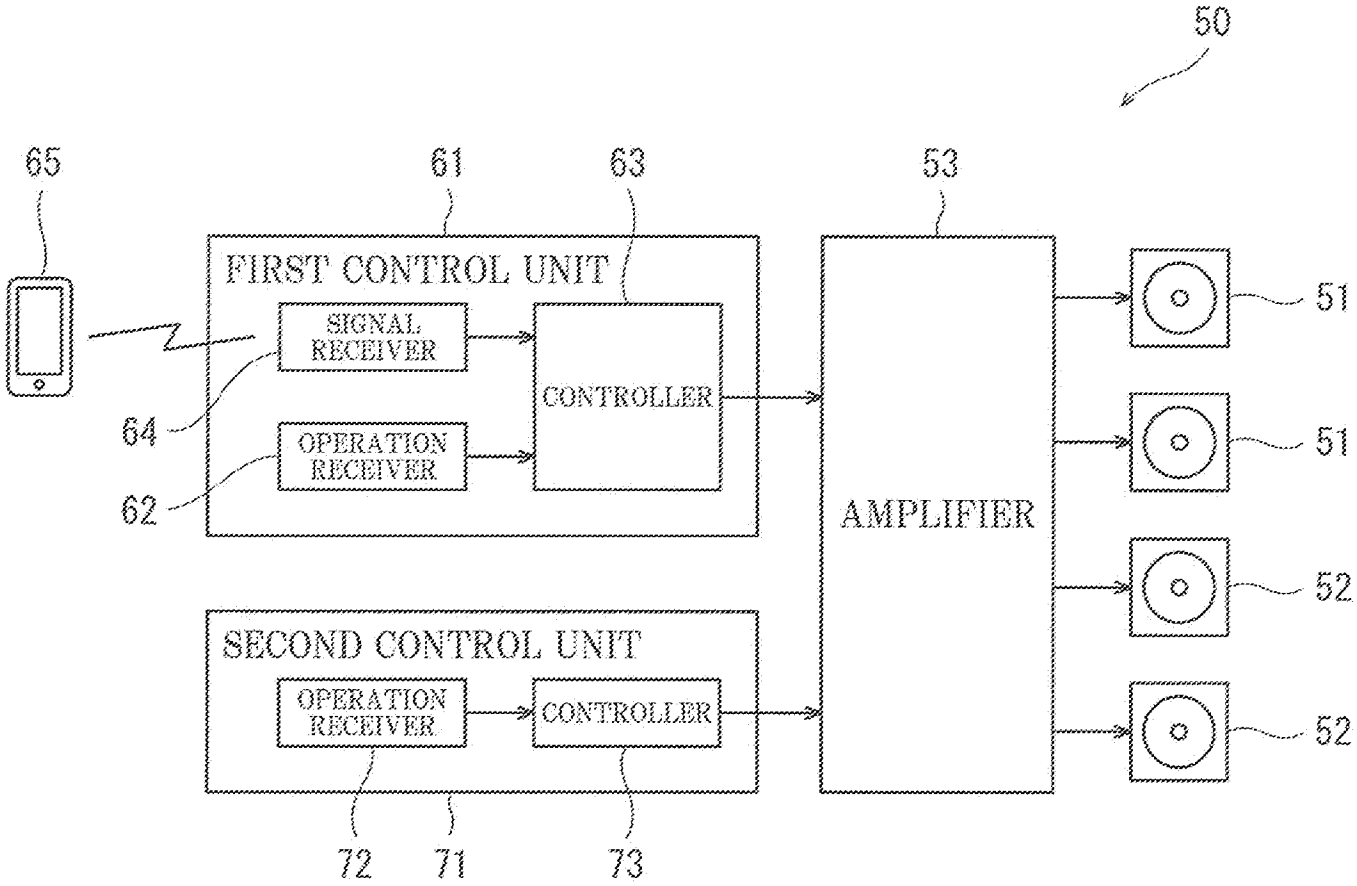
FIG. 5 is a block diagram showing a schematic configuration of an audio system of the personal watercraft of FIG. 1.

The personal watercraft 1 includes an audio system 50. FIG. 5 is a block diagram showing a schematic configuration of the audio system 50 of the personal watercraft 1 of FIG. 1. The audio system 50 includes two first speaker assemblies 51, two second speaker assemblies 52, an amplifier 53, a first control unit 61, and a second control unit 71. The two first speaker assemblies 51 and the two second speaker assemblies 52 are electrically connected to the amplifier 53. The first and second control units 61 and 71 are also electrically connected to the amplifier 53. Hereinafter, these elements of the audio system 50 will be described in detail.

Figure 6:
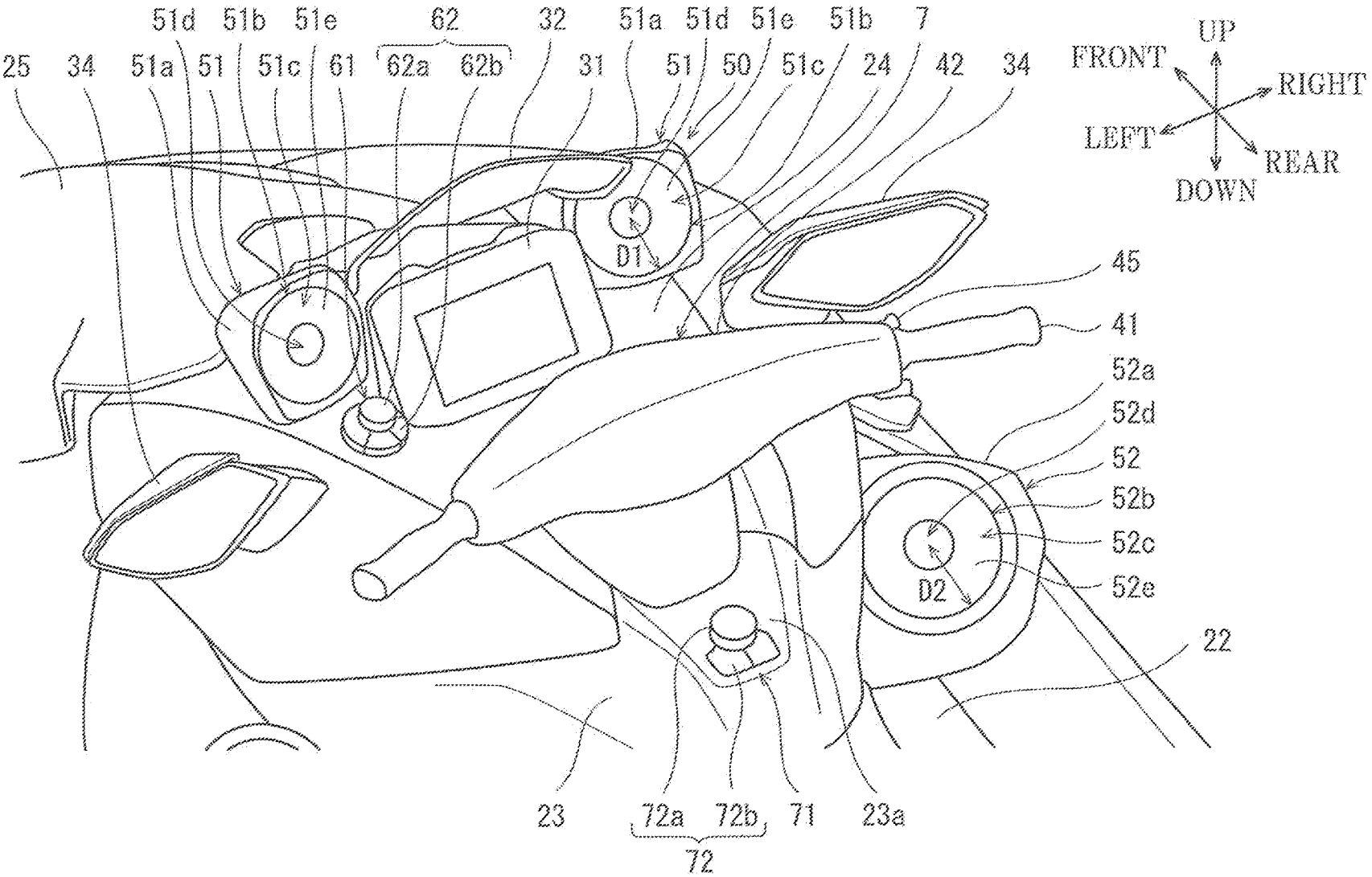
FIG. 6 is a partially enlarged perspective view of the personal watercraft of FIG. 1, showing the steering assembly and its vicinity as viewed from the left rear side.

FIG. 6 is a partially enlarged perspective view of the personal watercraft 1 of FIG. 1, showing the steering assembly 7 and its vicinity as viewed from the left rear side. Each of the two first speaker assemblies 51 converts a sound signal to a sound wave. Referring to FIG. 6, each first speaker assembly 51 includes a first housing 51*a* and a speaker 51*b* supported by the first housing 51*a*.

The speaker 51*b* of the first speaker assembly 51 includes a middle unit 51*c* and a tweeter unit 51*d* coaxial with each other; that is, the speaker 51*b* is a so-called coaxial two-way speaker. The tweeter unit 51*d* is located forward of the middle unit 51*c* in the direction of sound emission of the first speaker assembly 51. The tweeter unit 51*d* is coupled to the middle unit 51*c* by a supporting member (not shown) extending along the axis of the units 51*c* and 51*d*.

The middle unit 51*c* is a speaker unit for low and middle frequencies. The middle unit 51*c* includes a cone-shaped diaphragm. The tweeter unit 51*d* is a speaker unit for high frequencies. The tweeter unit 51*d* includes a diaphragm having a dome-shaped central portion and a cone-shaped outer circumferential portion. The term "cone-shaped" as used herein refers not only to the shape of a cone whose diameter increases at a constant rate in the direction of sound emission but also to the shape of a petal in which the rate of increase in diameter increases in the direction of sound emission. Each diaphragm vibrates in response to a sound signal received from the amplifier 53.

The diaphragm of the middle unit 51*c* is larger in diameter than the diaphragm of the tweeter unit 51*d*. In the following description, the larger diaphragm of the middle unit 51*c* is referred to as the "first diaphragm 51*e*" of the first speaker assembly 51 for convenience of explanation. In FIG. 6, the diameter of the first diaphragm 51*e* is shown by the reference sign D1.

As seen from FIGS. 1 to 3, the two first speaker assemblies 51 are located to the right and left of the meter device 31, respectively. The two first speaker assemblies 51 are located forward of the handle 41 in the front-rear direction. Specifically, the two first speaker assemblies 51 are at substantially the same location as the meter device 31 and the two side mirrors 34 in the front-rear direction. The two first speaker assemblies 51 are supported by the second cover 24 together with the meter device 31 and the two side mirrors 34. The two first speaker assemblies 51 are located above the two side mirrors 34 in the up-down direction. More specifically, the upper ends of the first speaker assemblies 51 are located above the upper ends of the side mirrors 34. The point of connection between each first speaker assembly 51 and the second cover 24 is located above the point of connection between each side mirror 34 and the second cover 24 (see FIGS. 1 and 3 in particular). The right first speaker assembly 51 is located between the meter device 31 and the right side mirror 34 in the right-left direction, and the left first speaker assembly 51 is located between the meter device 31 and the left side mirror 34 in the right-left direction. The two first speaker assemblies 51 are bilaterally symmetrical with respect to the center plane C dividing the watercraft body 2 into right and left halves.

In FIG. 4, the first speaker assembly 51 is shown by a dashed-two dotted line to illustrate the location of the first speaker assembly 51 in the up-down and front-rear directions relative to the other elements. The first speaker assembly 51 is located above the shaft support 44. The first speaker assembly 51 is located above the lowest point B of the upper surface of the seat 8. In FIG. 4, a horizontal plane passing through the lowest point B of the upper surface of the seat 8 is shown by a dashed line.

Each of the two second speaker assemblies 52 converts a sound signal to a sound wave. Referring to FIG. 6, each second speaker assembly 52 includes a second housing 52*a* and a speaker 52*b* supported by the second housing 52*a*.

The speaker 52*b* of the second speaker assembly 52 includes a middle unit 52*c* and a tweeter unit 52*d* coaxial with each other; that is, the speaker 52*b* is a so-called coaxial two-way speaker. The tweeter unit 52*d* is located forward of the middle unit 52*c* in the direction of sound emission of the second speaker assembly 52. The tweeter unit 52*d* is coupled to the middle unit 52*c* by a supporting member (not shown) extending along the axis of the units 52*c* and 52*d*.

The middle unit 52*c* is a speaker unit for low and middle frequencies. The middle unit 52*c* includes a cone-shaped diaphragm. The tweeter unit 52*d* is a speaker unit for high frequencies. The tweeter unit 52*d* includes a diaphragm having a dome-shaped central portion and a cone-shaped outer circumferential portion. Each diaphragm vibrates in response to a sound signal received from the amplifier 53.

The diaphragm of the middle unit 52*c* is larger in diameter than the diaphragm of the tweeter unit 52*d*. In the following description, the larger diaphragm of the middle unit 52*c* is referred to as the "second diaphragm 52*e*" of the second speaker assembly 52 for convenience of explanation. In FIG. 6, the diameter of the second diaphragm 52*e* is shown by the reference sign D2.

As seen from FIGS. 1 to 3, the two second speaker assemblies 52 are supported, respectively, by the front end portions of the pair of foot rests 22. The two second speaker assemblies 52 are bilaterally symmetrical with respect to the center plane C dividing the watercraft body 2 into right and left halves. The two second speaker assemblies 52 are located below the two first speaker assemblies 51 and outward of the two first speaker assemblies 51 in the watercraft body width direction (namely, the second speaker assemblies 52 are farther from the center plane C than the first speaker assemblies 51). The two second speaker assemblies 52 are located between the hatch cover 25 and the seat 8 in the front-rear direction.

In side view, the orientation of the first speaker assembly 51 relative to the watercraft body 2 and the orientation of the second speaker assembly 52 relative to the watercraft body 2 (the directions of sound emission of the first and second speaker assemblies 51 and 52) are different from each other. In other words, a sound axis L1 extending from the first speaker assembly 51 along the central axis of the first speaker assembly 51 and a sound axis L2 extending from the second speaker assembly 52 along the central axis of the second speaker assembly 52 are not parallel to each other. As seen from FIG. 1, the first and second speaker assemblies 51 and 52 are arranged such that the sound axes L1 and L2 pass by the head of the operator seated on the seat 8. In side view, the sound axis L1 of the first speaker assembly 51 and the sound axis L2 of the second speaker assembly 52 intersect each other at a point above the front of the seat 8, in particular at a point in the vicinity of the head of the operator seated on the seat 8.

In side view, the angle of the direction of sound emission of the first speaker assembly 51 with respect to the horizontal plane (namely, the angle of the sound axis L1 with respect to the horizontal plane) is smaller than the angle of the direction of sound emission of the second speaker assembly 52 with respect to the horizontal plane (namely, the angle of the sound axis L2 with respect to the horizontal plane).

In top view, the sound axes L1 of the two first speaker assemblies 51 intersect each other at the center plane C of the watercraft body 2, with the point of intersection located rearward of the handle 41. In top view, the sound axes L2 of the two second speaker assemblies 52 intersect each other at the center plane C of the watercraft body 2, with the point of intersection located rearward of the handle 41. In FIG. 2, only the sound axis L1 of the left first speaker assembly 51 and the sound axis L2 of the left second speaker assembly 52 are shown by dashed-two dotted lines for simplicity of the figure. In the illustrated example, the point of intersection between the sound axes L1 of the two first speaker assemblies 51 and the point of intersection between the sound axes L2 of the two second speaker assemblies 52 are at the same location in top view. In top view, the sound axis L1 of the first speaker assembly 51 and the sound axis L2 of the second speaker assembly 52 intersect each other at a point above the front of the seat 8, in particular at a point in the vicinity of the head of the operator seated on the seat 8. The point of intersection between the sound axes L1 of the two first speaker assemblies 51 and the point of intersection between the sound axes L2 of the two second speaker assemblies 52 need not coincide in top view, and may be at different locations in top view.

In top view, the angle of the direction of sound emission of the first speaker assembly 51 with respect to the vertical center plane C (namely, the angle of the sound axis L1 with respect to the center plane C) is smaller than the angle of the direction of sound emission of the second speaker assembly 52 with respect to the center plane C (namely, the angle of the sound axis L2 with respect to the center plane C).

The first speaker assembly 51 is smaller in size than the second speaker assembly 52. Specifically, the diameter D1 of the first diaphragm 51*e* as observed along the sound axis L1 is smaller than the diameter D2 of the second diaphragm 52*e* as observed along the sound axis L2. For example, the diameter D1 of the first diaphragm 51*e* is less than 130 mm, and the diameter D2 of the second diaphragm 52*e* is 130 mm or more. The first speaker assembly 51 is lighter than the second speaker assembly 52.

Since the diameter D2 of the second diaphragm 52*e* is larger than the diameter D1 of the first diaphragm 51*e*, the second speaker assembly 52 is more adapted to output low-frequency sounds than the first speaker assembly 51. However, middle- or higher-frequency sounds output from the second speaker assembly 52, which are highly directional, cannot easily reach locations rearward of the operator seated on the seat 8 because, as stated above, the angle of the sound axis L2 of the second speaker assembly 52 with respect to the horizontal plane is relatively large in side view. In the present embodiment, the first speaker assembly 51 serves to allow middle- or higher-frequency sounds to reach locations rearward of the operator. In the present embodiment, since the diameter D1 of the first diaphragm 51*e* is smaller than the diameter D2 of the second diaphragm 52*e*, the weight of the first speaker assembly 51 can be reduced, and at the same time middle- or higher-frequency sounds can be easily delivered to locations rearward of the operator. This feature is advantageous particularly in the personal watercraft 1 in which one or more persons can be seated behind the operator.

The amplifier 53 is associated both with the first speaker assemblies 51 and with the second speaker assemblies 52. The amplifier 53 amplifies a received sound signal and outputs the amplified sound signal to the first and second speaker assemblies 51 and 52. The amplifier 53 is disposed in the housing 52*a* of the right second speaker assembly 52 of the two second speaker assemblies 52 (see FIG. 2). This eliminates the need to dispose the amplifier 53 in the housing 51*a* of each first speaker assembly 51, thus leading to reduction in size and weight of the first speaker assemblies 51.

The first and second control units 61 and 71 send sound signals to the speaker assemblies 51 and 52 through the amplifier 53.

The first control unit 61 includes an operation receiver (audio operation receiver) 62 and a controller (audio controller) 63 electrically connected to the operation receiver 62. The operation receiver 62 receives an operation from a user (e.g., the operator). The operation receiver 62 includes a rotatable adjusting knob 62*a* and a plurality of push buttons 62*b*. The controller 63 sends a sound signal to the speaker assemblies 51 and 52 based on the operation performed by the user on the operation receiver 62.

The first control unit 61 is supported by the second cover 24 which serves also as the display support. The operation receiver 62 is arranged to project upward from the upper surface of the second cover 24. The first control unit 61 is located between the first speaker assemblies 51 and the seat 8 in the front-rear direction. The first control unit 61 is opposite the accelerator lever 45 with respect to the center plane C of the watercraft body 2; namely, the first control unit 61 is located to the left of the center plane C. More specifically, the first control unit 61 is located immediately behind the left first speaker assembly 51.

The first control unit 61 further includes a signal receiver 64 that wirelessly receives signals. The signal receiver 64 receives signals from a signal transmitter external to the first control unit 61 by wireless communication. The signal transmitter is, for example, a mobile terminal such as a smartphone carried by the user. The signal receiver 64 is, for example, a Bluetooth (registered trademark) receiver. The first control unit 61 may include, in addition to the signal receiver 64, a signal transmitter that transmits signals to an entity external to the first control unit 61 by wireless communication. The signal receiver 64 is electrically connected to the controller 63. A signal received by the signal receiver 64 is sent to the controller 63. The controller 63 sends a sound signal to the speaker assemblies 51 and 52 based on the signal received by the signal receiver 64.

The second control unit 71 includes an operation receiver (audio operation receiver) 72 and a controller (audio controller) 73 electrically connected to the operation receiver 72. The operation receiver 72 receives an operation from a user (e.g., the operator). The operation receiver 72 includes a rotatable adjusting knob 72*a* and a plurality of push buttons 72*b*. The controller 73 sends a sound signal to the speaker assemblies 51 and 52 based on the operation performed by the user on the operation receiver 72.

The second control unit 71 serves not only as a control unit for controlling the speaker assemblies 51 and 52 but also as a control unit for controlling the meter device 31. Specifically, the controller 73 sends to the meter device 31 a control signal (such as a signal instructing the meter device 31 to switch the displayed indicator from one to another) based on the operation performed by the user on the operation receiver 72.

The second control unit 71 is located rearward of the hatch cover 25 (in particular, rearward of the shaft support 44) and forward of the central front end 8*a* of the seat 8. The second control unit 71 is supported by the first cover 23.

Specifically, the upper surface of the first cover 23 is shaped such that the laterally central portion of the upper surface is recessed relative to the outer edge portion of the upper surface. The second control unit 71 is arranged such that the operation receiver 72 projects upward from the bottom of the recessed portion (referred to as "recess 23*a*") of the first cover 23. The operation receiver 72 is located below the right and left edges of the recess 23*a* of the upper surface of the first cover 23 (see FIG. 4). Thus, the operation receiver 72 is invisible in side view (see FIG. 2).

In the configuration described above, the first speaker assemblies 51 are located above the lowest point B of the upper surface of the seat 8. As such, sounds from the first speaker assemblies 51 can easily reach the location of the seated operator and locations rearward of the seated operator. The fact that sounds from the first speaker assemblies 51 can easily reach the operator is particularly advantageous in a vehicle such as a personal watercraft the occupants of which are not enclosed in a cabin or the like. Since the first speaker assemblies 51 are located above the lowest point B of the upper surface of the seat 8, the operator can easily recognize sounds output from the first speaker assemblies 51 even in the presence of external sounds such as the sound of waves and the sound generated due to friction between the traveling personal watercraft 1 and air.

In the personal watercraft 1 of the present embodiment, since the first speaker assemblies 51 are located above the shaft support 44 which is located above the lowest point B of the upper surface of the seat 8, sounds from the first speaker assemblies 51 can easily reach the location of the seated operator and locations rearward of the seated operator.

In the present embodiment, since the two first speaker assemblies 51 are bilaterally symmetrical with respect to the center plane C of the watercraft body 2, the first speaker assemblies 51 are expected to provide a surround effect which allows the user listening to the output sounds to feel a sense of expansion and a sense of depth.

In the present embodiment, since the two first speaker assemblies 51 are located to the right and left of the meter device 31, respectively, the two first speaker assemblies 51 can prevent the meter device 31 from being splashed with water coming from the right and left of the meter device 31.

In the present embodiment, the two first speaker assemblies 51 are supported by the display support, in particular the second cover 24 supporting the meter device 31. This eliminates the need for the watercraft body 2 to include an additional member for supporting the two first speaker assemblies 51.

In the present embodiment, since the watercraft body 2 is provided with not only the two first speaker assemblies 51 but also the two second speaker assemblies 52, the surround effect is expected to be greater than in a configuration where the watercraft body 2 is provided with only the two first speaker assemblies 51.

In the present embodiment, since the first speaker assembly 51 is smaller in size than the second speaker assembly 52, the strength of the support supporting the first speaker assembly 51 can be reduced.

In the present embodiment, in side view, the angle of the direction of sound emission of the first speaker assembly 51 with respect to the horizontal plane is smaller than the angle of the direction of sound emission of the second speaker assembly 52 with respect to the horizontal plane. As such, in side view, the point of connection between the sound axis L1 of the first speaker assembly 51 and the sound axis L2 of the second speaker assembly 52 can be close to the heads of occupants including the operator.

In the present embodiment, the longitudinal length (the diameter in the described example) of the first diaphragm 51*e* of the first speaker assembly 51 is smaller than the longitudinal length (the diameter in the described example) of the second diaphragm 52*e* of the second speaker assembly 52. The greater the longitudinal length of a diaphragm is, the lower the frequency of emitted sounds is. Thus, weight reduction of the first speaker assembly 51 can be achieved by reducing the longitudinal length of the first diaphragm 51*e*. The function of outputting low-frequency sounds which have low directionality can be performed mainly by the second speaker assembly 52.

In the present embodiment, the amplifier 53 associated both with the first speaker assemblies 51 and with the second speaker assemblies 52 is disposed in the housing 52*a* of one of the second speaker assemblies 52. This eliminates the need to dispose the amplifier 53 in the housing 51*a* of each first speaker assembly 51, thus leading to reduction in size and weight of the first speaker assemblies 51.

In the present embodiment, since the operation receiver 62 is opposite the accelerator lever 45 with respect to the center plane C of the watercraft body 2, the operator is less likely to perform erroneous operations.

In the present embodiment, the operation receiver 72 is located rearward of the hatch cover 25 and forward of the central front end 8*a* of the seat 8, the operator can easily perform audio-related operations without changing his/her posture.

Many modifications and other embodiments of the present invention will be apparent to those skilled in the art from the foregoing description. Accordingly, the foregoing description is to be construed as illustrative only, and is provided for the purpose of teaching those skilled in the art the best mode for carrying out the invention. The details of the structure and/or function may be varied substantially without departing from the scope of the invention.

For example, the numbers of the speaker assemblies 51 and 52 are not limited to those in the above embodiment. For example, the personal watercraft 1 may include one first speaker assembly 51 or three or more first speaker assemblies 51. For example, the personal watercraft 1 need not include any second speaker assemblies 52, and may alternatively include one second speaker assembly 52 or three or more second speaker assemblies 52. For example, the personal watercraft 1 may be configured to include only the first speaker assemblies 51 or the second speaker assemblies 52. The orientations and other properties of the speaker assemblies 51 and 52 are not limited to those in the above embodiment either.

While in the above embodiment a meter device is included as the display, the display need not be a meter device. While in the above embodiment the display and the first speaker assemblies 51 are supported together by the second cover 24 serving as the display support, the display and the first speaker assemblies 51 may be supported by different members. The personal watercraft 1 need not include any display located between the hatch cover and the handle in the front-rear direction. The one or more first speaker assemblies 51 may be mounted on the steering assembly 7. For example, the one or more first speaker assemblies 51 may be mounted on the handle 41 or the handle cover 42.

In the above embodiment, the first and second diaphragms 51*e* and 52*e* are cone-shaped; that is, the first and second diaphragms 51*e* and 52*e* are circular when viewed along the sound axes. Alternatively, the first and second diaphragms 51*e* and 52*e* may be elliptical or polygonal when viewed along the sound axes. Also in this case, the longitudinal length of the first diaphragm 51*e* is smaller than the longitudinal length of the second diaphragm 52*e*.

While in the above embodiment the speakers 51*b* and 52*b* of the first and second speaker assemblies 51 and 52 are coaxial two-way speakers, the speakers 51*b* and 52*b* are not limited to coaxial two-way speakers. For example, the speaker of either the first speaker assembly 51 or second speaker assembly 52 may be a full-range or vertical twin speaker, or the speakers of both the first and second speaker assemblies 51 and 52 may be full-range or vertical twin speakers. For example, the speaker of either the first speaker assembly 51 or second speaker assembly 52 may be a one-way or three or more-way speaker, or the speakers of both the first and second speaker assemblies 51 and 52 may be one-way or three or more-way speakers. The second speaker assembly 52 may be specialized for output of low-frequency sounds; for example, the second speaker assembly 52 may be configured to include only a woofer unit. It is noted, however, that an enhanced surround effect can be expected when, as in the above embodiment, both the first and second speaker assemblies 51 and 52 are configured to output middle- or higher-frequency sounds.

The audio system 50 may be devoid of either the first control unit 61 or the second control unit 71. The operation receivers 62 and 72 of the first and second control units 61 and 71 are not limited to the configurations described in the above embodiment. The controller 63 may be located away from the operation receiver 62, and the controller 73 may be located away from the operation receiver 72. For example, each of the operation receivers 62 and 72 may consist of an adjusting knob or a plurality of push buttons. The functions of the controllers 63 and 73 may be implemented by a single controller connected to both of the operation receivers 62 and 72. That is, the first and second control units 61 and 71 may share a single controller rather than respectively including the controllers 63 and 73. The second control unit 71 may, instead of the first control unit 61, include the signal receiver 64. The sounds output from the speaker assemblies of the audio system 50 are not limited to particular kinds of sounds, and may be musical sounds or non-musical sounds. The audio system 50 may include a microphone.

What is claimed is:

1. A personal watercraft comprising:

a watercraft body comprising a hull and a deck covering an upper portion of the hull;

a handle located above the deck;

a straddle seat located rearward of the handle;

at least one speaker assembly located forward of the straddle seat and above the lowest point of an upper surface of the straddle seat;

a steering shaft penetrating the deck in an up-down direction and having an upper end on which the handle is mounted; and a shaft support mounted on the deck and pivotally supporting the steering shaft, wherein the at least one speaker assembly is located above the shaft support.

2. The personal watercraft according to claim 1, wherein the at least one speaker assembly includes two speaker assemblies which are bilaterally symmetrical with respect to a center plane dividing the watercraft body into right and left halves.

3. The personal watercraft according to claim 2, further comprising:

a hatch cover located forward of the handle; and a display located between the hatch cover and the handle in a front-rear direction and located above the lowest point of the upper surface of the straddle seat, wherein the two speaker assemblies are located to the right and left of the display, respectively.

4. The personal watercraft according to claim 1, further comprising:

a hatch cover located forward of the handle;

a display located between the hatch cover and the handle in a front-rear direction and located above the lowest point of the upper surface of the straddle seat; and a display support supporting the display, wherein the at least one speaker assembly is supported by the display support.

5. The personal watercraft according to claim 1, wherein the at least one speaker assembly is at least one first speaker assembly, the personal watercraft further comprises two second speaker assemblies other than the at least one first speaker assembly, the deck comprises a pair of foot rests located to the right and left of the straddle seat, respectively, and the two second speaker assemblies are mounted on front end portions of the two foot rests, respectively.

6. The personal watercraft according to claim 5, wherein the first speaker assembly is smaller in size than the second speaker assembly.

7. The personal watercraft according to claim 5, wherein each of the first and second speaker assemblies comprises a diaphragm, and a longitudinal length of the diaphragm of the first speaker assembly is smaller than a longitudinal length of the diaphragm of the second speaker assembly.

8. A personal watercraft comprising:

a watercraft body comprising a hull and a deck covering an upper portion of the hull;

a handle located above the deck;

a straddle seat located rearward of the handle; and at least one first speaker assembly located forward of the straddle seat and above the lowest point of an upper surface of the straddle seat; and two second speaker assemblies other than the at least one first speaker assembly, wherein the deck comprises a pair of foot rests located to the right and left of the straddle seat, respectively, the two second speaker assemblies are mounted on front end portions of the two foot rests, respectively, and in side view, an angle of a direction of sound emission of the at least one first speaker assembly with respect to a horizontal plane is smaller than an angle of a direction of sound emission of each of the two second speaker assemblies with respect to the horizontal plane.

9. A personal watercraft comprising:

a watercraft body comprising a hull and a deck covering an upper portion of the hull;

a handle located above the deck;

a straddle seat located rearward of the handle;

at least one first speaker assembly located forward of the straddle seat and above the lowest point of an upper surface of the straddle seat; and two second speaker assemblies other than the at least one first speaker assembly, wherein the deck comprises a pair of foot rests located to the right and left of the straddle seat, respectively, the two second speaker assemblies are mounted on front end portions of the two foot rests, respectively, each of the first and second speaker assemblies comprises a housing, the personal watercraft further comprises an amplifier that amplifies a sound signal and outputs the amplified sound signal to the first and second speaker assemblies, and the amplifier is disposed in the housing of one of the second speaker assemblies.

10. The personal watercraft according to claim 1, further comprising:

a hatch cover located forward of the handle;

an audio operation receiver that receives an operation from an operator; and an audio controller that controls the at least one speaker assembly based on the operation performed by the operator on the audio operation receiver, wherein the audio operation receiver is located rearward of the hatch cover and forward of a central front end of the straddle seat.

11. The personal watercraft according to claim 1, wherein the handle comprises an accelerator located on a first side with respect to a center plane dividing the watercraft body into right and left halves, the personal watercraft further comprises:

an audio operation receiver that receives an operation from an operator; and an audio controller that controls the at least one speaker assembly based on the operation performed by the operator on the audio operation receiver, and the audio operation receiver is located between the at least one speaker assembly and the straddle seat in a front-rear direction and located on a second side opposite the first side with respect to the center plane of the watercraft body.

* * * * *